United States Patent [19]

Wolfson

[11] 4,122,942

[45] Oct. 31, 1978

[54] HYDROPHILIC CONTACT LENS CASE

[76] Inventor: Leonard G. Wolfson, 15 Varick Rd., Newton, Mass. 02168

[21] Appl. No.: 597,591

[22] Filed: Jul. 21, 1975

Related U.S. Application Data

[62] Division of Ser. No. 438,443, Jan. 31, 1974, abandoned.

[51] Int. Cl.[2] ..... A45C 11/04

[52] U.S. Cl. ..... 206/5.1; 351/160 H

[58] Field of Search ..... 206/5.1, 205, 213.1; 351/160 H, 166

[56] References Cited

U.S. PATENT DOCUMENTS

| | | | |
|---|---|---|---|
| 3,414,117 | 12/1968 | Leeds | 206/5.1 |
| 3,431,046 | 3/1969 | Conrad | 351/160 H |
| 3,520,949 | 7/1970 | Shepherd | 351/160 H |
| 3,532,679 | 10/1970 | Steckler | 351/160 H |
| 3,536,040 | 10/1970 | Pickett | 351/160 H |
| 3,695,280 | 10/1972 | Sturgeon | 206/5.1 |
| 3,767,790 | 10/1973 | Guttac | 351/160 H |
| 3,895,169 | 7/1975 | Wichterle | 351/160 H |

*Primary Examiner*—Ro E. Hart

*Attorney, Agent, or Firm*—Schiller & Pandiscio

[57] ABSTRACT

A hydrophilic contact lens with at least the surfaces formed of a high molecular weight synthetic polymer, is treated by exposure to a plasma of an inert gas under near-vacuum conditions. The treated lenses are stored in aqueous solution held in a plastic storage case, at least the interior surfaces of the storage case having also been treated with the inert gas plasma to also render its interior surfaces hydrophilic.

3 Claims, 3 Drawing Figures

HYDROPHILIC CONTACT LENS CASE

This is a division of U.S. patent application Ser. No. 438,443 filed Jan. 31, 1974 now abandoned.

This invention relates to contact lenses, and more particularly to a method of making a more comfortable contact lens, and the lens per se.

Contact lenses, transparent optics intended to be worn immediately adjacent the corneal surface of the eye, have been known for a number of years. Such lenses initially proved to be irritating to the eye and could only be worn for very short periods of time. In efforts to reduce the irritation caused by such lenses and also to improve the clarity of vision provided by the lens, experiments have been performed on the lens dimensions, type of material used for the lenses and the like. During the course of such experimentation it had been established that if the surfaces of the lenses were hydrophilic, the wearer would experience improved vision and comfort. The enhanced wettability of the lens apparently reduces direct contact between the lens and corneal surfaces and thereby reduces irritation. The improved wettability of the lens also minimizes lens/air interfaces in the presence of tear fluid thereby enhancing vision.

For safety reasons, contact lenses are almost invariably formed of plastic (high molecular weight synthetic polymers) material which minimizes the danger of shattering that is present if the lenses are formed of a vitreous material. Efforts have been made to alter the surface of such plastic materials, such as polymethylmethacrylate to render the surface hydrophilic. For example, R. A. Erb coated a polymethymethacrylate substrate with a thin film of titanium dioxide, as detailed in *Method for Producing Wettable Surfaces on Contact Lenses by Chemical Formation of Inorganic Films,* U.S. Department of Commerce Research report AD-257290, March, 1961. Coating such as titanium dioxide must be chemically inert and extremely thin, must not interfere with the optical transmission of the lens, must be durable and scratch-resistant, and must adhere well to the lens surface. Obviously, many of these requirements are diametrically opposed so that the result is frequently a compromise which is not completely satisfactory.

A principal object of the present invention is therefore to provide a method for treating plastic contact lenses which renders the surface of the lenses highly hydrophilic without substantially altering the transmission quality of the lenses or introducing any stresses or distortions in the lens surface; to provide such a method in which the surface exhibits very stable hydrophilic properties; to provide such a lens which has considerably enhanced wettability, has longer wearing time and feels very smooth and comfortable on the patient's eye.

Preferably, to accomplish the foregoing and other objects, the present invention comprises the treatment of the surface of a plastic lens (and case) with an ionized plasma of an inert gas at reduced ambient pressures, for a time sufficient to render the surface of the lens hydrophilic, without heating the lens sufficiently to introduce optical distortion or stress.

It is preferred that contact lenses be stored, usually in a saline solution which may contain cleaners such as detergents or the like, in a case having a well with a snap-on cover, at least the well and cover being usually made of a soft plastic material so that the lens will not be scratched by contact with the case. Because the lenses of the present invention are highly hydrophilic, (and it is postulated that this may be due to the creation of polar moieties at the surface of the lens by bombardment by ions in the plasma) the lens tends to "attract" particles or films rather readily. It has now been found that by also treating at least the interior of the well and cover of the lens case with the same plasma treatment, the interior surface of the case will also render hydrophilic. Hydrophilic lenses stored in such a treated case tend to require much less cleaning than similar lenses stored in an untreated case. The combination of such a treated case, and the combination thereof with a hydrophilic lens is embraced also by the present invention.

Other objects of the present invention are to provide a plastic contact lens which has a surface which wets with an extremely small contact angle with respect to aqueous fluid, which wettability is a substantially permanent attribute of the lens; and to provide a novel case for storing hydrophilic lenses.

Other objects of the present invention will in part be obvious and will in part appear hereinafter. The invention accordingly comprises the processes involving the several steps and the relation and order of one or more of such steps with respect to each of the others, and the products and compositions possessing the features, properties and relation of elements which are exemplified in the following detailed disclosure and the scope of the application all of which will be indicated in the claims.

For a fuller understanding of the nature and objects of the present invention, reference should be had to the following detailed description taken in connection with the accompanying drawings wherein.

Contact lenses of the present invention are those formed of or coated with plastic materials, for example, polymethymethacrylate, silicone resins, polyethylene and the like, and even such highly inert or normally hydrophilic materials as polytetrafluorethylene, polycarbonates and the like, hitherto of doubtful utility for contact lenses. The choice of plastic material for the lenses is of course primarily dictated by such characteristics as compatibility with eye tissue, optical qualities and mechanical qualities whereby the lens can be shaped without introducing distortion-producing stresses. The entire lens may be made of a simple plastic, or may be formed of other materials coated with a plastic sheath.

Figure 1:
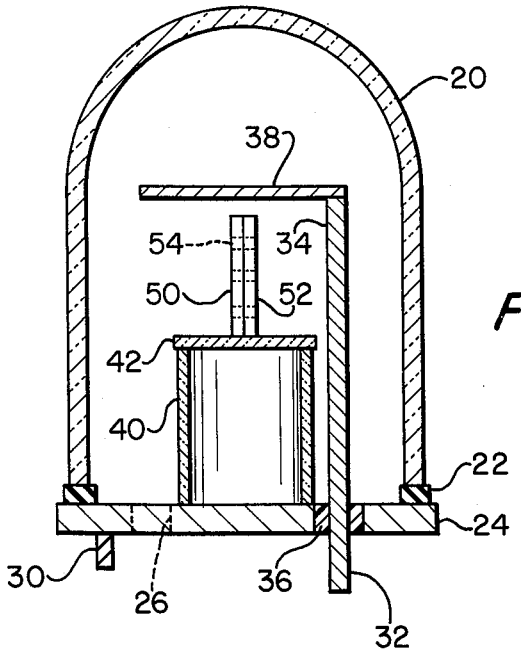
FIG. 1 is a schematic elevational view of apparatus for treating contact lenses according to the present invention.

FIG. 1 shows a side view of a portion of an existing machine for producing low pressure plasmas of inert gases, and which machine is useful to treat contact lenses according to the present invention. Typically this machine can be a National Research Corporation (Massachusetts) Vacuum Evaporator Model 3116 which includes an 18 inch diameter bell jar 20 having an elastic sealing rim 22 typically formed of rubber or some other similar material. The bell jar is supported on electrically conductive table 24 which is typically formed of steel, brass or the like. The atmosphere within the bell jar can be exhausted through opening or port 26 in table 24.

Port 26 is preferably connected to the usual mechanical and/or diffusion type vacuum pumps (not shown). Electrical power terminals 30 and 32 are provided, the first being electrically coupled to table 24. Terminal 32 is connected to electrically conductive post 34 which extends through an insulating bushing 36 in table 24 and terminates at a position intermediate the top and bottom portions of bell jar 20. Mounted on post 34 and electrically connected thereto is an electrically conductive ring or loop 38, typically formed of aluminum or the like. An electrical power supply, typically National Research Corporations's High Voltage power supply Model 1901 (not shown) is connected to terminals 30 and 32 to provide electrical power to the latter. Preferably the power supply should be able to provide voltages up to approximately 4 to 5 kilovolts at densities of 300 to 400 ma DC.

Additionally, means (not shown) should be provided for valving conduits to port 26 so that not only can the atmosphere within the bell jar be exhausted to a desired pressure, but also so that inert gases can be introduced into the bell jar through port 26. Of course it is desirable to provide appropriate instrumentation such as voltmeters, ammeters and the like which indicate the power being applied across terminals 30 and 32; and ionization gauges which indicate the internal pressure in the bell jar.

Means, typically in the form of glass cylinder 40 and glass plate 42 mounted on one end of cylinder 40 are provided as a support which permits lenses being treated to be appropriately positioned between loop 38 and table 24.

Figure 2:
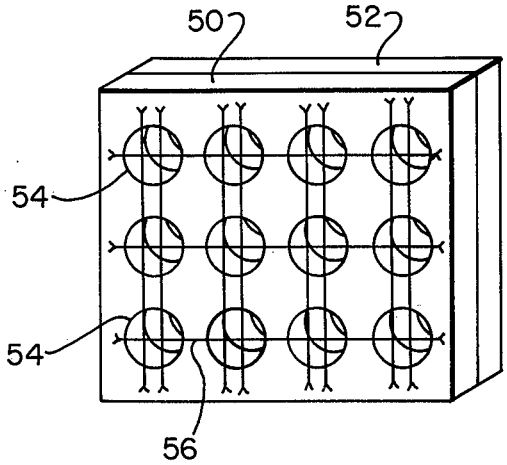
FIG. 2 is a support particularly useful in connection with the treatment of lenses according to the present invention.

Because treatment in a bell jar type of device is necessarily a batch treatment, it is desirable to treat a plurality of lenses in each batch. To this end, as shown in FIG. 2 there is provided lens holder which is typically formed of two plastic plates 50 and 52, each of which has a set or array of cylindrical holes such as 54 therein. The array of holes in plate 50 is matched to those of plate 52 so that each set of matched holes constitutes a cylindrical tube running through the plates when the latter are coupled to one another with matching holes 54 registered with one another. Across the exterior surfaces of plates 50 and 52 (only the exterior surface of plate 50 being shown) are disposed restraining lines or netting, typically in the form of a single or double strand 56 of a plastic filament, such as a fine nylon monofilament extending substantially diametrically across each hole. Thus, the tube formed by each pair of matching holes is "closed" at each end by one or more plastic filaments, so that material disposed within the tube cannot readily fall out of the latter.

Holes 54 are preferably dimensioned in diameter to be slightly greater than the maximum diameter of the largest contact lens to be treated. Similarly, the thickness dimensions of plates 50 and 52 are selected such that when clamped to one another with matched holes in registration, the axial length of the tubes thus formed is substantially less than the diameter of the holes, but somewhat greater than the maximum height of the contact lens of greatest curvature to be treated. It will be seen that a lens disposed within a pair of matched holes such as 54 will have its opposite surfaces substantially facing outwardly from opposite sides of plates 50 and 52.

In operation, it is desirable to first place cleaned lenses within the holes of sample plate 50, plate 50 being held horizontal so that the lenses are supported on filaments 56. Plate 52 is then positioned adjacent plate 50 so that the matched holes are registered and the two plates are then clamped together by any appropriate known clamping mechanism (not shown).

Bell jar 20 is raised well above table 24 and clamped plates 50 and 52, containing the plastic contact lenses to be treated, are placed vertically on glass plate 42 as shown in FIG. 1. The vertical height of cylinder 40 and plate 42 are such that, even though plates 50 and 52 are placed upon the edge so that the cylindrical axes of holes 54 are substantially horizontal. The upper edges of plates 50 and 52 are preferably disposed below loop 38. Bell jar 20 is then lowered until sealing ring 22 is in firm contact with plate 24, and the interior of the bell jar is then pumped down, typically to a pressure of less than 50 mm Hg.

Once the pressure within the bell jar has fallen below 50 mm Hg, a small stream of inert gas such as nitrogen, argon or the like should be introduced, for example through port 26, to sweep or flush the interior of the bell jar and the bell jar then pumped down again until the pressure has again fallen below the 50 mm level. Both the inert gas flow and pumping can then be stopped, or alternatively one can continue to trickle the inert gas into the bell jar while continuing pumping provided that in either case the pressure in the bell jar is maintained substantially below the 50 mm level, preferably at 30–40 mm.

Power is then applied across terminals 30 and 32 to induce thereby a glow discharge, i.e. formation of a plasma between loop 38 and table 24.

It is known that such a glow discharge will occur once the breakdown potential for the gas in the bell jar has been exceeded. The pressure within the bell jar should not be reduced to such a vacuum that the glow discharge can no longer be maintained. The glow discharge is continued until the surfaces of the lenses held in clamp plates 50 and 52 are rendered hydrophilic, and terminated before the lenses can heat to a point at which stresses are introduced. The length of time the glow discharge should be continued, to a large extent is determined by the power density of current in the glow discharge. Typically for example, in a nitrogen atmosphere at a pressure of 40 mm Hg, the discharge should be about a minute and one half for an input power of 1350 volts at 70 ma D.C. The exact values of pressure and power for various combinations of given inert gases and plastic materials can readily be determined by routine observations.

When a lens is rendered hydrophilic, an observable change occurs on the surface of the lens. The surface of the lens appears to be more highly specularly reflecting and apparently smoother. Such a change can readily be observed for example by simply treating a slab of plastic, supported on plate 42, a portion of the plastic being sealed so as to not be exposed to the glow discharge. Upon removal of the plastic slab and stripping away the sealing, the difference between the treated and untreated surfaces is readily visually apparent, and the marked resulting differential wettability of the two surfaces is also easily observed.

Figure 3:
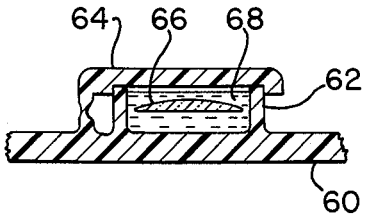
FIG. 3 is a cross-section taken through a typical lens of the present invention disposed within a storage case treated according to the present invention.

Lenses treated according to the present invention retain their hydrophilic properties apparently indefinitely and will continue to wet extremely well unless the surface is mechanically removed by abrasion or the like or is soiled. If the surface is exposed to an oily material, the wettability will be substantially reduced, until the oil is removed with a cleaning solution. Cleaning solutions containing ketones and alcohols should not be used with lenses of the present invention because their use, for unknown reasons, not only irreversibly impairs the hydrophilic character of the surface, but tends to cloud the lens. The lenses should be stored wet in order to optimally preserve the hydrophilic character of the lens surface. To this end, the lenses should be stored in the usual soft plastic case, such as is shown in cross section in FIG. 3. The case of FIG. 3, as is usual in the art, is a unitary molded product comprising base support sheet 60 upon which a cylindrical well 62 is formed. Hinged to well 62 so as to form a waterproof, snap-on seal is cap 64. Lens 66 as shown is preferably stored in well 62 in the usual aqueous storage solution 68.

As noted, it has been found that the wettability of stored lenses is maintained and the requirement for cleaning the lenses is substantially reduced if at least the interior of well 62 and cap 64 are also treated by exposure to a plasma of an inert gas, in the same manner as has heretofore been described in connection with contact lenses. It will be appreciated that this is an important advantage in storing the lenses inasmuch as usually the less cleaning required of a lens, smaller is the opportunity for damage to the lens surface.

Since certain changes may be made in the above process without departing from the scope of the invention herein involved, it is intended that all matter contained in the above description or shown in the accompanying drawing shall be interpreted in an illustrative and not in a limiting sense.

What is claimed is:

1. A storage case for hydrophilic contact lenses, said cases comprising;

a well formed of high molecular weight synthetic polymeric material substantially softer than the material of said lens, and having a sealable cap dimensioned to fit over said well, the interior surface of said well having been treated by exposure to a plasma of an inert gas at a pressure substantially below atmospheric until said interior surfaces have been rendered hydrophilic.

2. A method of storing hydrophilic contact lenses said method comprising the steps of:

forming a well with an interior surface of a high molecular weight synthetic polymeric material, said material being substantially softer than the material of said lens, exposing at least the interior surface of said well to a plasma of an inert gas at pressures substantially below atmospheric until said interior surface has been rendered hydrophilic, and placing said lenses and an aqueous storage solution in said well.

3. Method as defined in claim 2 including the step of releasibly sealing said well with a removable cap, said cap being dimensioned to fit over said well.

* * * * *